United States Patent [19]

Chukhanov et al.

[11] 4,244,700

[45] Jan. 13, 1981

[54] METHOD OF AND APPARATUS FOR HEAT PROCESSING OF PULVERIZED SOLID FUEL

[76] Inventors: Zinovy F. Chukhanov, ulitsa D. Ulyanova, 3, kv. 40; Zinovy Z. Chukhanov, ulitsa Obrucheva, 6, kv. 352; Sergei A. Tsuprov, Bolshoi Vuzovsky pereulok, 1, kv. 26; Vadim A. Karasev, Leninsky prospekt, 16, kv. 30; Anatoly M. Nikolaev, Scherbakovskaya ulitsa, 5, kv. 76, all of Moscow; Robert M. Shibaev, ulitsa Sklidkova, 93, kv. 57, Kalinin; Boris F. Bratchenko, ulitsa Alexeya Tolstogo, 15, kv. 5; Ivan V. Lyashenko, Lesnaya ulitsa, 45, kv. 89, both of Moscow, all of U.S.S.R.

[21] Appl. No.: 19,663

[22] Filed: Mar. 12, 1979

[51] Int. Cl.[3] ..... C10L 9/08; C10L 1/32

[52] U.S. Cl. ..... 44/1 R; 44/1 B; 44/2; 44/33; 44/51; 208/8 R

[58] Field of Search ..... 44/1 R, 1 B, 1 G, 1 F, 44/2, 28, 33; 208/8 R; 201/25, 37

[56] References Cited

U.S. PATENT DOCUMENTS

| | | | |
|---|---|---|---|
| 2,600,430 | 6/1952 | Riblett | 208/8 R |
| 3,733,183 | 5/1973 | Singh | 44/2 X |
| 4,100,032 | 7/1978 | Elberg | 44/1 F |
| 4,134,794 | 1/1979 | Lorenz et al. | 201/37 X |

*Primary Examiner*—Carl F. Dees
*Attorney, Agent, or Firm*—Steinberg & Raskin

[57] ABSTRACT

According to the invention pulverized solid fuel is processed by heating the fuel to a temperature at which thermal decomposition of the fuel begins and subsequently heating the fuel to a temperature at which an intense thermal decomposition of the fuel takes place to form a vapor-and-gas suspension containing pulverized particles, gas, tar vapors and pyrogenic water vapors. The resultant vapor-and-gas suspension is cooled in a chamber by water and/or pyrogenic water to a temperature from 360° to 140° C. at which pulverized solid particles adsorb heavy tar. To obtain the resulting product in the form of a pulp, the vapor-and-gas suspension is cooled for a second time to a temperature from 80° to 20° C. at which the fractures of intermediate and light tars are condensed.

Combustion heat of resulting solid matter is higher than that of the product obtained by a conventional method; in addition, it may be conveyed by a water channel. The resulting product in the form of a pulp may be conveyed by a water channel directly to the consumer. When practising the method, such side product as pyrogenic water is utilized which is usually purified prior to disposal.

7 Claims, 1 Drawing Figure

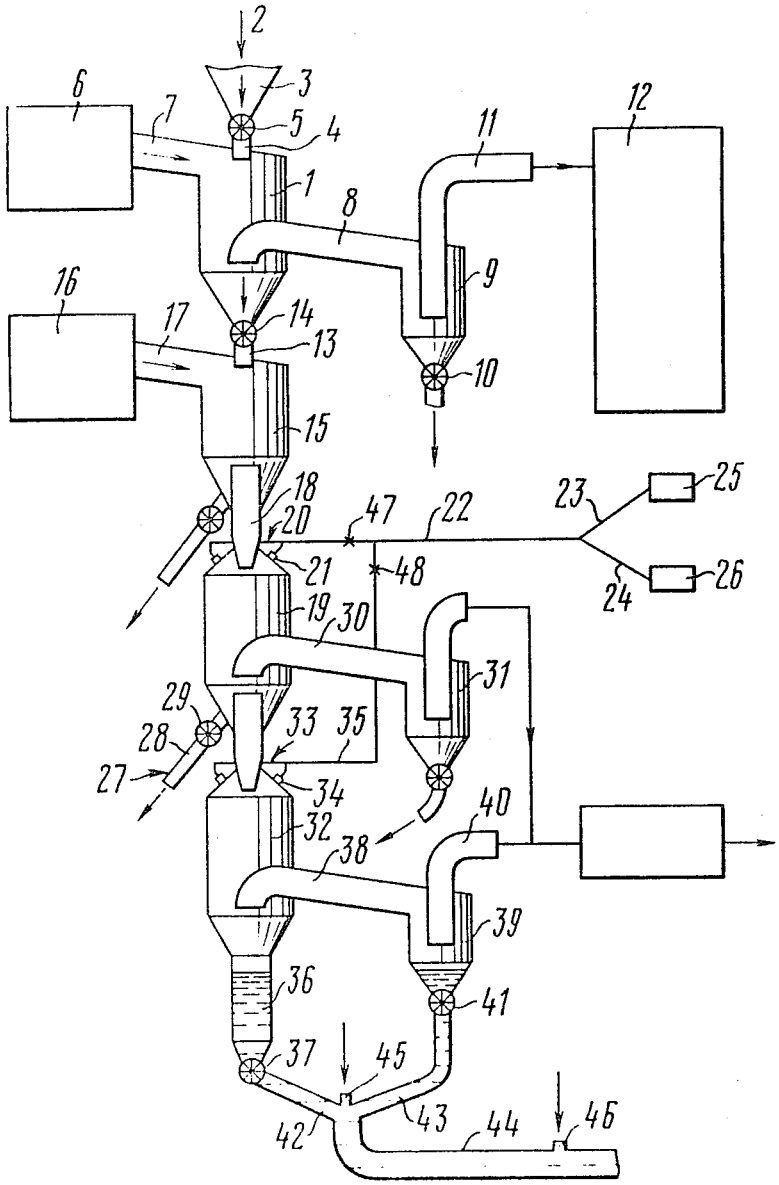
2
3
6
7
5
4
11
12
1
8
9
16
17
14
13
10
15
18
20
47
22
23
25
21
48
24
26
19
30
31
29
28
33
35
27
34
40
32
38
39
36
41
37
45
42
43
44
46

METHOD OF AND APPARATUS FOR HEAT PROCESSING OF PULVERIZED SOLID FUEL

The invention relates to methods of and apparatus for break-down processing of solid carbon-containing stock, and more specifically, to methods of and apparatus for heat processing of pulverized solid fuel.

The invention is particularly suitable for a combined production of both high-energy pulverized fuel intended for industrial and domestic furnaces as well as of gaseous and liquid products of various applications.

BACKGROUND OF THE INVENTION

Methods of and apparatus for pyrolysis, or heat processing of pulverized solid fuel having the particle size below 1 mm at high heating rates on the order of $10^3$ to $10^6$ degrees per second are well known in the art. As compared with those based on slow-rate heating, such methods provide for an increased yield of both solid and liquid products which are subsequently converted into synthetic liquid fuel and into technical and chemical raw materials.

There is known in the art one prior-art method of and apparatus for heat processing of pulverized solid fuel, as disclosed in the USSR Inventor's Certificate No. 335,267.

The above method for heat processing of pulverized solid fuel includes the steps of heating the fuel by a gaseous heat carrier within less than one second to a temperature of 300° to 500° C. at which decomposition thereof begins, followed by heating the fuel by the heat carrier within less than one second to a temperature of 500° to 800° C. at which thermal decomposition thereof grows very intense to form a vapour-and-gas suspension containing solid particles, gas, tar vapours and water vapours, breaking the resultant vapour-and-gas suspension into a solid matter and a vapour-and-gas mixture, purifying and condensing the vapour-and-gas mixture to produce gas, useful liquid products and to separate heavy tars and pyrogenic water therefrom.

The above apparatus for heat processing of pulverized solid fuel comprises a first chamber provided with a means for feeding a charge fuel thereto and with a means for delivering a gaseous heat carrier thereto and discharging it therefrom, the gaseous heat carrier being intended to heat the fuel to a temperature at which thermal decomposition thereof begins, a second chamber successively connected to the first one and provided with a means for delivering the gaseous heat carrier thereto to heat the fuel to a temperature at which thermal decomposition thereof grows very intensive to form a vapour-and-gas suspension, with a means for separating a solid matter from the vapour-and-gas mixture, and with a separator for purifying the vapour-and-gas mixture and feeding it for consideration to obtain gas, useful liquid products and to separate tar and pyrogenic water therefrom.

The above method and the apparatus for practising same, similar to other methods known in the art, and apparatus for fast pyrolysis, provide an increased yield of tar. An overall increased yield of tar naturally involves an increased content of heavy tar therein. Though the combustion heat of the resultant heavy tar (8400 large calories per kilogram) is known to be higher than that of the resultant solid matter (6400 to 6700 large calories per kilogram), its use as fuel presents some difficulties. These difficulties are explained by its being an amporphous plastic substance which is too viscous to be delivered to the consumer through a pipeline and insufficiently hard for transportation in tanks. Thus, in order to use heavy tar as a liquid fuel, it must to be converted to liquid state by heating, which naturally involves additional power, time and labour consumption.

As it is known commonly, said apparatus for processing pulverized solid fuel according to the above method yields solid product in the form of small particles having a porous surface. This causes both an increased hygroscopcity of solid product and its tendency to pulverization. A high hygroscopicity rules out the possibility of storing the solid product outdoors, while its tendency to pulverization makes the working conditions unhealthy and causes considerable losses of fuel. It should be noted that the process yields also such side product as pyrogenic water which contains organic compounds dissolved therein. Prior to disposal, pyrogenic water must be decontaminated, which results in rather high capital and production costs.

It is an object of the invention to develop a method of and an apparatus for heat processing of pulverized solid fuel which enable the production of a solid matter having an increased combustion heat.

Another object of the invention is to provide a method for heat processing of pulverized solid fuel and an apparatus for practising the method which enable heavy tar to be adsorbed by pulverized particles of solid matter.

A further object of the invention is to provide a method of and an apparatus for heat processing of pulverized solid fuel which yield a solid matter suitable for being conveyed by water channels.

A still further object of the invention is the provision of a method of and an apparatus for heat processing of pulverized solid fuel allowing utilization of pyrogenic water which is a side product requiring decontamination prior to disposal.

Among the objects of the invention is also to provide a method of and an apparatus for heat processing of pulverized solid fuel which enable the manufacture of energy-producing fuel in the form of a pulp suitable for being conveyed by water channels.

SUMMARY OF THE INVENTION

The foregoing and other objects are attained by a method of heat processing of pulverized solid fuel including the steps of heating the fuel by a gaseous heat carrier within less than one second to a temperature from 300° to 500° C. at which thermal decomposition of the fuel begins, followed by heating the fuel by a gaseous heat carrier within less than one second to a temperature from 500° to 800° C. at which thermal decomposition of the fuel grows very intense to form a vapour-and-gas suspension containing solid particles, gas, tar vapours and water vapours, breaking the resultant vapour-and-gas suspension into solid matter and vapour-and-gas mixture, purifying and condensing the mixture to obtain gas, useful liquid products and to separate pyrogenic water therefrom, according to the invention the resultant vapour-and-gas suspension, prior to being broken into a solid matter and a vapour-and-gas mixture, is cooled by a direct contact thereof with a coolant to a temperature from 360° to 140° C. at which pulverized particles of the solid matter adsorb heavy tars.

On cooling to a temperature of above 360° C. the amount of heavy tar adsorbed by pulverized particles of the fuel is practically negligible, while on cooling to a temperature below 140° C. the amount of tar adsorbed by pulverized particles grows to high values as a result of condensing intermediate tar, thereby causes excessive agglutination of solid matter.

Water may be used as a coolant.

It is good practice to use as coolant, pyrogenic water or light tar resulting from the heat processing of solid fuel.

The resultant vapour-and-gas suspension may be once more cooled by water to a temperature from 80° to 20° C. to obtain the resulting product in the form of a pulp. In this case cooling of the vapour-and-gas suspension to a temperature of above 80° C. makes impossible the condensation of pyrogenic water and the tar unadsorbed by the solid matter. Cooling below 20° C. requires, as a rule, additional equipment.

The foregoing and other objects are also attained by an apparatus for heat processing of pulverized solid fuel, comprising a first chamber provided with a means for feeding a charge fuel thereto and with a means for delivering a gaseous heat carrier thereto and discharging it therefrom, the gaseous heat carrier being intended to heat the fuel to a temperature of thermal decomposition thereof, a second chamber successively connected to the first one and provided with a means for delivering the gaseous heat carrier into the second chamber to heat the fuel to a temperature at which thermal decomposition thereof grows very intense to form a vapour-and-gas suspension, according to the invention incorporates a third chamber successively connected to the second chamber and provided with a means, communicating with a coolant source, for spraying a coolant in the third chamber to cool the vapour-and-gas suspension to a temperature at which pulverized particles of solid matter adsorb heavy resins, and with means for discharging solid matter from the third chamber.

Thus, the third chamber communicating with a coolant source permits the vapour-and-gas suspension to be cooled to a temperature at which heavy tar is adsorbed by pulverized particles, and this in turn enables the production of a solid matter having an increased combustion heat. Besides, in this state the solid matter is suitable for being conveyed by water channels and practically does not pulverize.

It is advisable that an additional chamber be successively connected to the third chamber of the foregoing apparatus, said additional chamber being provided with a means for spraying water therein to cool the vapour-and-gas suspension in order to obtain the resulting product in the form of a pulp, and also with a means and a separator to discharge the resultant pulp and gas mixture, respectively therefrom.

It is possible to put in communication said separator, as well as a means for discharging the pulp, with a pulp conveying pipeline. This allows for discharging from the separator water and solid particles which may be caught therein and for conveying the pulp directly to the consumer.

It is advisable to provide said pipeline with connection pipes for adding solid matter or water therethrough in order to change the pulp concentration.

BRIEF DESCRIPTION OF THE DRAWINGS

The foregoing and other objects of the invention will become more apparent from the consideration of a detailed description of the embodiments of the invention taken in conjunction with the accompanying drawing which shows a diagrammatic view of an apparatus for heat processing of pulverized solid fuel.

DESCRIPTION OF THE PREFERRED EMBODIMENT OF THE INVENTION

The proposed method of heat processing of pulverized solid fuel is practised in the following manner.

Pulverized solid fuel having the particle size less than 1 mm is preheated to a temperature of 110° C. for the purpose of drying.

The pulverized solid fuel so prepared is heated by a gaseous heat carrier clear of free oxygen in less than one second to a temperature of 300°–500° C. at which thermal decomposition of the fuel begins. The used heat carrier is separated from the fuel already heated to a temperature of 300°–500° C., and then the fuel is subjected to further heating by the gaseous heat carrier in less than one second to a temperature of 500°–800° C. at which intense thermal decomposition of the fuel takes place to form a vapour-and-gas suspension consisting of solid particles gas, tar vapours and water vapours. According to the invention the resultant vapour-and-gas suspension is subjected to forced cooling by a direct contact thereof with a coolant to a temperature of 360°–140° C. at which pulverized particles of the solid matter adsorb heavy tar. Water or pyrogenic water which is to be purified prior to disposal is used for cooling the vapour-and-gas suspension.

When it is desirable to obtain the resulting product in the form of solid fuel, the pulverized particles which have adsorbed heavy tars are separated from the vapour-and-gas mixture and delivered to the consumer. The resultant vapour-and-gas mixture is in turn directed to be purified and condensed in order to obtain useful liquid products and to separate pyrogenic water therefrom.

Thus, the adsorbtion of heavy tar pulverized particles increases the combustion heat of the solid matter, enables it to be conveyed by water channels and prevents pulverization.

It should be noted that when cooling the vapour-and-gas suspension to a temperature of above 360° C., the amount of heavy tar adsorbed by pulverized particles of the fuel is practically negligible, that is, the advantages of the proposed method are lost. On the other hand, when cooling the resultant vapour-and-gas suspension to a temperature below 140° C., the amount of tar adsorbed by pulverized particles grows to high values due to condensation of intermediate resin. A considerable adsorption of tar by pulverized particles is responsible for an excessive agglutination of solid matter, which in turn causes the sticking of solid matter to the walls of facilities intended for discharging the resulting product.

To obtain the resulting product in the form of a pulp, the vapour-and-gas suspension cooled to a temperature of 360°–140° C. is subjected to a second forced cooling by water to a temperature of 80°–20° C. On cooling, intermediate and part of light tar are condensed, which together with solid particles and the coolant form a pulp suitable to be delivered directly to the consumer. In this case, the cooling of the vapour-and-gas suspension to a temperature of above 80° excludes the complete condensation of pyrogenic water and of light tar unadsorbed by solid matter. The cooling below 20° C. requires, as a rule, additional equipment and, consequently, additional capital and operational production costs.

Due to the condensation of fractures of intermediate and part of light tar the resulting product in the form of a pulp is characterized by an increased combustion heat and may be delivered through a pipeline directly to the consumer. Moreover, when pyrogenic water is used as coolant, there is no need for it to be purified prior to disposal, because organic combustible substances dissolved therein, e.g., phenylic acids, are utilized.

The apparatus for heat processing of pulverized solid fuel comprises a first cyclone chamber 1 formed as a cylindrical shell with an abutting tapered bottom (not shown). The first chamber 1 is provided with a means 2 for feeding thereto pulverized solid fuel to be processed. This means 2 incorporates a hopper 3 for a charge fuel, which hopper is connected by a conduit 4 to the first chamber 1. A turnstile-type feeder 5 is built into the conduit 4. Abutting the upper portion of the first chamber 1 is means 6 for delivering a gaseous heat carrier thereto to heat the fuel to a temperature at which thermal decomposition thereof begins to form a vapour-and-gas suspension containing solid particles, gas, tar vapours and water vapours. The means 6 for delivering the heat carrier is provided with a connection pipe 7 which tangentially adjoins the shell of the first chamber 1. A burner communicating with the gas fuel source (both not shown) is coaxially mounted within the connection pipe 7. The burner serves for burning a gas fuel to produce a heat carrier in the form of a stack gas practically free of oxygen. A connection pipe 8 is coaxially mounted within the first chamber 1 and connects the latter to a means 9 for discharging the used-up heat carrier. A turnstile-type gate 10 is provided for discharging unutilized fuel taken away by the heat carrier while a conduit 11 connected to the furnace of a boiler 12 is intended to discharge the heat carrier.

A second cyclone chamber 15 is successively connected to the first chamber 1 by a conduit 13 with a turnstile feeder 14. To deliver the gaseous heat carrier into the second cyclone chamber 15 and to heat the fuel to a temperature of its intense thermal decomposition, the above chamber 15 is provided with a means 16 incorporating a connection pipe 17 which tangentially adjoins the second chamber 15 and includes a burner (not shown) coaxially mounted therein for burning the fuel to produce a gaseous heat carrier in the form of oxygen-free stack gas.

A third cyclone-type chamber 19 is successively connected to the second chamber 15 by a conduit 18. Abutting the upper portion of the third chamber 19 is a means 20 for spraying a coolant to cool the vapour-and-gas suspension to a temperature at which heavy tar 15 is adsorbed by pulverized particles of solid matter. Said means 20 comprises a plurality of sprayers 21 tangentially mounted within the third chamber 19. The sprayers 21 are connected to a conduit 22 which communicates through conduits 23 and 24 with sources 25 and 26 of ordinary and pyrogenic water, respectively. The third chamber 19 comprises means 27 for discharging solid matter in the form of pulverized particles which have adsorbed heavy tar, and means 27 being formed as a connection pipe 28, provided with a turnstile-type metering device 29. Besides, a connection pipe 30 is coaxially mounted within the third chamber 19 which connection pipe connects the latter to a cyclone separator 31 for discharging the vapour-and-gas mixture and delivering it for condensation to obtain gas and useful liquid products.

An additional cyclone chamber 32 is successively connected to the third chamber 19. Mounted in the upper portion of the additional chamber 32 is a means 33 for spraying water in the chamber 32 to cool the vapour-and-gas suspension in order to obtain the resulting product in the form of a pulp. The above means comprises a plurality of sprayers 34 tangentially mounted within the third chamber 19. The spayers 34 are connected by conduits 35 and 23 to the trade effluent source 25 and to the pyrogenic water source 26, respectively.

Abutting the lower portion of the additional chamber 32 is a means 36 for discharging the pulp, said means 36 being a vertically positioned pipe provided at the end with a turnstile type metering device 37 for releasing the pulp.

A connection pipe 38 is coaxially positioned within the additional chamber 32, the bent end of the connection pipe 38 connecting the chamber 32 to a separator 39 formed as a wet cyclone. The upper portion of the separator 39 is provided with a conduit 40 for discharging gas and partially light tar vapours. The lower portion of the separator 38 is provided with a turnstile-type metering device 41 for discharging solid particles settled in the separator 38. The means 36 for discharging the pulp and the separator 39 are connected through conduits 42 and 43 to a pulp pipeline 44. The pipeline 44 is provided with connection pipes 45 and 46 for adding therethrough solid matter and water in order to change the pulp concentration.

The conduits 22 and 35 are provided with control members 47 and 48 for controlling coolant supply.

The description of operation of the apparatus will also aid in understanding the proposed method for heat processing of pulverized solid fuel, brown coal being selected as a starting fuel to illustrate the operation.

The apparatus for heat processing pulverized solid fuel operates in the following manner.

The pulverized brown coal having a particle size below 1 mm is preheated to a temperature of about 100° C. for the purpose of drying and thereafter fed by the feeder 5 from the hopper 3 into the first chamber 1. Simultaneously an oxygen-free heat carrier in the form of stack gas having a temperature of not less than 500° C. is delivered into the chamber 1 through the connection pipe 7.

The heat carrier tangentially enters the chamber 1 in the ratio of 200 kg per 1 ton of fuel and entrains the particles of pulverized brown coal. Under the action of centrifugal and gravity forces the coal particles are thrown towards the chamber wall and descend in the vortex. The pulverized coal is heated by the heat carrier to a temperature of about 500° C. The utilized gaseous heat carrier cooled down to 350° C. is discharged through the connection pipe 8 into the cyclone 9.

A portion of the pulverized fuel carried away by the heat carrier is separated therefrom in a conventional manner. Subsequently, the utilized heat carrier is directed for secondary utilization to any heat consumer, e.g., into the furnace of the boiler 12.

The feeder 14 feeds the coal being processed from the first chamber 1 into the second chamber 15. Concurrently with the fuel, the heat carrier in the form of a stack gas heated to a temperature of above 900° C. is fed into this chamber through the connection pipe 17. The heat carrier is fed in the ratio of 310 kg per 1 ton of coal. In the second chamber 15 in some fractions of a second the coal is heated to a temperature of 500°-800° C. at which thermal decomposition of the coal takes place to form a vapour-and-gas suspension containing solid particles and a vapour-and-gas mixture.

Through the conduit 18 the resultant vapour-and-gas suspension enters the third chamber 19. Simultaneously a coolant, e.g., pyrogenic water resulting from the coal processing, is introduced into the chamber 19 through the sprayers 21 from the source 26.

The amount of the coolant delivered into the chamber 19 is sufficient for cooling the vapour-and-gas suspension to a temperature of 360°-140° C., namely 700 kg per 1 ton of fuel being processed. Under these conditions pulverized coal particles actively adsorb heavy tar vapours, i.e., pulverized coal particles become gummed. When it is desired to obtain the resulting solid matter in the form of pulverized gummed particles, the same are discharged from the chamber 19 by the turnstile-type metering device 29. In this case the resultant vapour-and-gas mixture is delivered through the connection pipe 30 into the separator 31, freed therein from solid particles and directed for condensation to obtain gas and useful liquid products. Pyrogenic water resulting from condensation is delivered into the source 26 to be used as coolant.

Solid matter resulting from thermal decomposition is a high-energy fuel calorific power of which has risen from 6400 -6700 large calories per kilogram to about 6600-7200 large calories per kilogram due to the adsorption of heavy tar by pulverized particles. This being the case, the hygroscopicity of the solid product has greatly decreased.

From the third chamber 19 the vapour-and-gas suspension containing solid matter, vapour-and-gas mixture and water is delivered into the additional cooling chamber 32. Simultaneously trade effluent is tangentially fed into the additional chamber 32 through sprayers 34 to cool the vapour-and-gas suspension to a temperature of from 80° to 20° C. This causes condensation of vapours of heavy, intermediate and light tar fractions as well as of water, and together with gummed particles of solid matter they form a suspension which flows into the means 36 for discharging the pulp. Non-condensed vapour-and-gas mixture is delivered through the connection pipe 38 into the wet cyclone 39, wherein it is freed from solid and liquid admixtures. The purified vapour-and-gas mixture is delivered for further processing, where useful products are separated from this mixture in the regular way, while the remaining gas is supplied to the furnace of the boiler 12.

From the means 36 for discharging the pulp and from the separator 39 the pulp is delivered by the metering devices 37 and 41 to the pipeline 44 which communicates with the pulp consumer. When it is desired to change the pulp concentration, water or solid product in the form of pulverized particles which have adsorbed heavy tar are added to the pulp through the connection pipes 46 and 45.

EXAMPLE 1

Brown coal having an ash content of 9.6% was pulverized until the particle size was less than 1 mm. and preheated to the temperature of 110° C. for the purpose of drying. Subsequently, the coal was fed into the cyclone chamber 1 and heated by a gas heat carrier in the form of stack gas clear of free oxygen and having a temperature not lower than 500° C. The stack gas was delivered into the cyclone chamber 1 in the ratio of 200 kg per 1 ton of coal. In fractions of a second (about 0.3 sec.) the charge coal was heated to a temperature of 300°-500° C., i.e., to the temperature at which thermal decomposition of the charge coal begins. Such fast heating practically did not change the composition of the coal since only 20 kg of matter was removed therefrom consisting of pyrogenic water, gas and entrained coal.

Heated to the temperature of the beginning of thermal decomposition, the coal was delivered into the second cyclone chamber 15 where it was entrained by a vortex of hot stack gas, also clear of free oxygen, the ratio being 310 kg of stack gas per 1 ton of the fuel being processed. The stack gas temperature was not lower than 900° C. Mixed with the stack gas, the coal was heated in about 0.3 second to a temperature of 500°-800° C., i.e., to the temperature of thermal decomposition of the fuel to form a vapour-and-gas suspension containing per 1 ton of organic coal: 530 kg of solid matter, 260 kg of pyrolysis gas, 120 kg of tar having the boiling temperature of 240° C. and of natural gasoline and 70 kg of pyrogenic water which containing 4.5% of water soluble phenylic acids and other organic compounds.

According to the invention the resultant vapour-and-gas suspension was delivered into the third cyclone chamber 19 and cooled by a direct contact thereof with water which was tangentially fed into the chamber 19.

To eliminate the necessity of purifying pyrogenic water resulting from the coal processing, this water was used as coolant. To cool the vapour-and-gas suspension to a temperature of 360° C. and of 140° C., there were supplied 710 and 1230 kg of water, respectively, per ton of the charge coal. On cooling the vapour-and-gas suspension to a temperature of about 360° C. and 140° C. the solid matter weighing 530 kg adsorbed in turn 72 and 110 kg of tar, respectively.

When it was desired to obtain a solid resulting product, solid matter was partially or completely separated from the vapour-and-gas suspension.

When solid matter was completely separated from the vapour-and-gas suspension, the latter was delivered for purification with subsequent treatment, usually by condensing, to produce useful liquid and gas products.

Solid matter resulting from thermal decomposition of the coal was a high-energy fuel the calorific power of which, as compared with that of the charge coal, had risen from 6400-6700 to 6600-7200 large calories per kilogram due to the adsorption of heavy tars by pulverized particles. As the pulverized particles of solid matter were covered with a thin layer of tar, the hygroscopicity of solid matter had markedly decreased. Besides, solid matter was amenable to briquetting.

Since hygroscopicity of the solid matter had appreciably decreased, conveying thereof through water channels became possible. Second cooling resulted in condensation of the previously unadsorbed fractions of intermediate and light tar, as well as of pyrogenic water vapours which in combination with solid particles and water produced a mixture in the form of a pulp. The resulting product in the form of a pulp was delivered through a water channel to the consumer. The pyrogenic gas resulting from the cooling of the vapour-and-gas suspension was also purified and delivered to the consumer, e.g., into the furnace of the boiler of the apparatus for practising the method according to the invention.

The combustion heat of the pulp produced in the foregoing manner is two–three times that of the coal-and-water pulp based on natural coal.

EXAMPLE 2

Milled peat (decomposition level 45–60%, ash content 5.7%) was crushed to about 0 to 60 microns and dried until residual moisture content was about 9%. The peat thus prepared was fed into the cyclone chamber 1 and heated therein by stack gases having a temperature not less than 350° C. Stack gases were supplied in the ratio of 160–230 kg per ton of the charge peat. In 0.3 second the peat was heated to a temperature of 250°–300° C. at which thermal decomposition of peat begins. With such fast heating the peat composition remained practically unchanged. Heated to a temperature of the beginning of thermal decomposition the peat was delivered to the second cylone chamber 15 and again heated in a stream of stack gases having a temperature not less than 600° C. Stack gases were supplied in the ratio of 180–270 kg per ton of the peat. In fractions of a second (about 0.3 sec.) the peat was heated to a temperature of 500°–550° C. at which an intense thermal decomposition of peat takes place to form a vapour-and-gas suspension. The resultant vapour-and-gas suspension contained per ton: 50% of tar, 34% of solid matter, 11% of water-soluble phenols and other organic compounds and 5% of pyrogenic gas.

According to the invention the resultant vapour-and-gas suspension was delivered into the third cyclone chamber 19 and subjected to forced cooling by a direct contact of the chamber with water which was tangentially fed into the chamber. To avoid purification of the pyrogenic water resulting from the peat processing, the former was used as coolant.

To cool the vapour-and-gas suspension to a temperature of about 360°–140° C., 605 and 930 kg of water, respectively, were supplied per 1 ton of the charge peat. On cooling the steam-and-gas suspension to a temperature of about 360° and 140° C., solid matter weighing 500 kg adsorbed 45 and 82 kg of tar, respectively.

To obtain the resulting product in the form of solid matter the latter was partially or completely separated from the vapour-and-gas mixture. When solid matter was completely separated from the vapour-and-gas mixture, the latter was delivered for purification with subsequent treatment for obtaining useful liquid and gaseous products.

Solid matter resulting from thermal decomposition of the peat is a high-energy fuel the calorific power of which, as compared with the charge peat, has risen from 6000 to 6300 large calories per kilogram due to the adsorption of heavy tar by pulverized particles. Hygroscopicity of the resultant fuel has appreciably decreased, and the fuel became amenable to briquetting.

Because of its low hygroscipicity the resultant solid matter may be water—conveyed to the consumer. To reduce the fuel hygroscopicuty, according to the invention the vapour-and-gas suspension cooled to a temperature of 360°–140° C. was delivered into another cyclone chamber and subjected to a second heating to a temperature of 80°–20° C. It resulted in the condensation of vapours or fractures of intermediate and light tars, unadsorbed by solid matter and of pyrogenic water in combination produced a mixture in the form of a pulp. The resultant pulp was delivered to the consumer, while the cooled pyrogenic gas was fed into the wet cyclone 39, wherein it was freed from solid particles and liquid admixtures and delivered to the consumer.

The resultant solid matter in the form of pulverized particles which had adsorbed heavy tar was separated from the vapour-and-gas suspension, and the latter was directed to be purified and condensed to produce gas and useful liquid products. Pyrogenic water resulting from the condensation of the vapour-and-gas suspension was freed of tar and utilized as coolant.

While there have been herein disclosed but the preferred embodiments of the method and apparatus according to the invention, other embodiments and modifications thereof within the scope of the appended claims will be obvious to those skilled in the art.

What we claim is:

1. A method of heat processing of pulverized solid fuel, which comprises heating the fuel by a substantially oxygen-free gaseous heat carrier in less than one second to a temperature from 300° to 500° C. at which thermal decomposition of the fuel begins, subsequently heating the fuel by a substantially oxygen-free gaseous heat carrier in less than one second to a temperature from 500° to 800° C. at which an intense thermal decomposition of the fuel takes place to form a vapour-and-gas suspension containing solid particles, gas, tar vapours and water vapours, and cooling the resultant vapour-and-gas suspension by direct contact thereof with a coolant to a temperature of 360°–140° C. at which pulverized solid particles adsorb heavy tar, breaking the resultant vapour-and-gas suspension into solid matter and vapour-and-gas mixture to obtain useful liquid products.

2. A method according to claim 1, wherein water is used as coolant for cooling the vapour-and-gas suspension.

3. A method according to claim 2, wherein the vapour-and-gas suspension is cooled for a second time to a temperature of 80°–20° C. to obtain the resulting product in the form of a pulp.

4. A method according to claim 1, wherein pyrogenic water resulting from the processing is used as coolant for cooling the vapour-and-gas suspension.

5. An apparatus for heat processing of pulverized solid fuel comprising:

a first chamber, first feed means for feeding fuel into said first chamber, gas delivery means for delivering a substantially oxygen-free gaseous heat carrier into said first chamber to heat the fuel to a temperature at which thermal decomposition of the fuel begins and first discharge means for discharging the used gaseous heat carrier from said first chamber;

a second chamber operatively connected to said first chamber, first conduit means for transfer of the fuel from said first chamber to said second chamber, second gas delivery means for delivering a substantially oxygen-free gaseous heat carrier into said second chamber to heat the fuel to a temperature at which an intensive thermal decomposition of the fuel takes place to form a vapour-and-gas suspension consisting of solid particles, tar vapours, water vapours and gases;

a third chamber operatively connected to said second chamber, second conduit means for transfer of vapour-and-gas suspension from said second chamber to said third chamber, spray means for delivering and spraying a coolant within said third chamber to cool the vapour-and-gas suspension to a temperature at which pulverized solid particles adsorb heavy tar, second discharge means for discharging the vapour-and-gas suspension from said third chamber and third discharge means for discharging the resultant solid matter from said third chamber.

6. An apparatus according to claim 5, comprising an additional chamber operatively connected to said third chamber, second spray means for delivering and spraying water in said additional chamber to cool for a second time the vapour-and-gas suspension to obtain the resulting product in the form of a pulp, fourth discharge means for discharging the pulp from said additional chamber and a separator for discharging a vapour-and-gas mixture from said additional chamber.

7. An apparatus according to claim 6, comprising a pipeline for conveying the pulp, which pipeline is connected to said means for discharging the pulp and to said separator and is provided with connection pipes for adding solid matter or water to said pipeline to change the pulp concentration.

* * * * *